US009604475B2

(12) United States Patent
Smolenski et al.

(10) Patent No.: US 9,604,475 B2
(45) Date of Patent: Mar. 28, 2017

(54) MEDIA PROCESSING DEVICE WITH ENHANCED MEDIA AND RIBBON LOADING AND UNLOADING FEATURES

(71) Applicant: ZIH Corp., Lincolnshire, IL (US)

(72) Inventors: Larry E. Smolenski, Newbury Park, CA (US); David L. Garbe, Ventura, CA (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 15/143,998

(22) Filed: May 2, 2016

(65) Prior Publication Data

US 2016/0325565 A1 Nov. 10, 2016

Related U.S. Application Data

(60) Provisional application No. 62/158,874, filed on May 8, 2015.

(51) Int. Cl.

| | |
|---|---|
| ***B41J 2/15*** | (2006.01) |
| ***B41J 11/04*** | (2006.01) |
| ***B41J 2/32*** | (2006.01) |

(52) U.S. Cl.
CPC *B41J 11/04* (2013.01); *B41J 2/32* (2013.01)

(58) Field of Classification Search
CPC . B41J 11/04; B41J 11/485; B41J 13/02; B41J 13/03
See application file for complete search history.

(56) References Cited

U.S. PATENT DOCUMENTS

| | | | | |
|---|---|---|---|---|
| 4,855,756 A | | 8/1989 | Gluck et al. | |
| 5,905,513 A | * | 5/1999 | Brandon | B41J 2/1433 347/33 |
| 5,953,035 A | * | 9/1999 | Watanabe | B41J 11/42 346/134 |

(Continued)

FOREIGN PATENT DOCUMENTS

| | | |
|---|---|---|
| EP | 0885736 A2 | 12/1998 |
| EP | 1826017 A2 | 8/2007 |
| EP | 2765005 A1 | 8/2014 |

OTHER PUBLICATIONS

International Searching Authority, "Written Opinion," mailed on Nov. 7, 2016 in connection with International Patent Application No. PCT/US2016/030869 (9 pages).

(Continued)

*Primary Examiner* — Lamson Nguyen

(57) ABSTRACT

Provided herein is a media processing device including a printhead assembly, a frame, and a biasing element. The printhead assembly includes a printhead and a printhead bracket, where the printhead assembly extends in a longitudinal direction between a first end and a second end, and where the printhead bracket includes a biasing force receiving element. The frame may be configured to receive and support the printhead assembly, where the frame includes a first portion disposed adjacent to the first end of the printhead assembly, and a second frame portion is disposed adjacent to the second end of the printhead assembly. The biasing element may extend between the first frame portion and the second frame portion, where the biasing element may engage the biasing force receiving element of the printhead assembly.

24 Claims, 6 Drawing Sheets

(56) References Cited

U.S. PATENT DOCUMENTS

| | | | |
|---|---|---|---|
| 7,918,618 | B2 | 4/2011 | Zevin et al. |
| 9,211,744 | B2 | 12/2015 | Wong et al. |
| 2007/0212142 | A1 | 9/2007 | Zevin et al. |
| 2015/0165797 | A1 | 6/2015 | Chari et al. |

OTHER PUBLICATIONS

International Searching Authority, "International Search Report," mailed on Nov. 7, 2016 in connection with International Patent Application No. PCT/US2016/030869 (7 pages).

* cited by examiner

MEDIA PROCESSING DEVICE WITH ENHANCED MEDIA AND RIBBON LOADING AND UNLOADING FEATURES

RELATED APPLICATION

This patent claims the benefit of U.S. Provisional Patent Application No. 62/158,874, filed May 8, 2015, which is hereby incorporated herein by reference in its entirety.

BACKGROUND OF THE INVENTION

Various embodiments of the invention are directed to printers and other systems for processing media including labels, receipt media, cards, and the like. Applicant has identified a number of deficiencies and problems associated with the manufacture, use, and maintenance of conventional printers. Through applied effort, ingenuity, and innovation, Applicant has solved many of these identified problems by developing a solution that is embodied by the present invention, which is described in detail below.

BRIEF SUMMARY

Various embodiments of the present invention are directed to a system and method for printing to a media substrate, and more particularly, to systems and methods for providing a method of more reliably printing using a self-adjusting and balancing printhead to apply consistent pressure across a print line.

Embodiments of the present invention may provide a media processing device including a printhead assembly, a frame, and a biasing element. The printhead assembly may include a printhead and a printhead bracket, where the printhead assembly extends in a longitudinal direction between a first end and a second end, and where the printhead bracket includes a biasing force receiving element. The frame may be configured to receive and support the printhead assembly, where the frame includes a first portion disposed adjacent to the first end of the printhead assembly, and a second frame portion is disposed adjacent to the second end of the printhead assembly. The biasing element may extend between the first frame portion and the second frame portion, where the biasing element may engage the biasing force receiving element of the printhead assembly. The biasing element may include a rod extending between the first frame portion and the second frame portion, where the rod is deflected in response to engaging the biasing force receiving element. The biasing force receiving element may define a rounded engagement surface and the biasing element may be configured to engage the biasing force receiving element about a portion of the rounded engagement surface. The biasing force receiving element may define a channel configured to receive the biasing element.

According to some embodiments, a cross engagement structure may include the biasing force receiving element and the biasing element, and may enable rotation of the printhead assembly about two orthogonal axes. At least one of the first frame portion or the second frame portion may include a rotation limit stop to limit the degree of rotation of the printhead about at least one of the orthogonal axes. The rotation limit stop may limit the degree of rotation about both of the orthogonal axes. A first one of the orthogonal axes may extend between the first frame portion and the second frame portion, and a second one of the orthogonal axes may extend orthogonal to a radius of curvature of the rounded engagement surface of the biasing force receiving element. A biasing force applied by the biasing element to the biasing force receiving element may remain constant during rotation of the printhead assembly about the two orthogonal axes.

Embodiments of the present invention may include a printhead assembly including a printhead extending in a longitudinal direction between a first end and a second end, a printhead bracket extending along the longitudinal direction of the printhead, and a biasing force receiving element disposed on the printhead bracket. The biasing force receiving element may include a rounded engagement surface having a radius, where the radius is about an axis that is perpendicular to the longitudinal direction along which the printhead extends. The biasing force receiving element may define a channel for receiving a biasing element. In response to the biasing force receiving element engaging the biasing element, the printhead may be pivotable relative to the biasing element in at least two orthogonal directions. A first of the two orthogonal axes may be parallel to the longitudinal direction in which the printhead extends, and a second of the two orthogonal axes may be parallel to the axis about which the radius of the biasing force receiving element extends.

According to some embodiments, the printhead may extend in a longitudinal direction across a media feed path, where a media feed direction is defined along a first direction of the media feed path, and a backfeed direction is defined opposite the media feed direction. The printhead may define a backfeed deflection surface configured to guide the printhead over media units disposed on a media substrate in response to the media substrate being moved in the backfeed direction.

Embodiments of the invention described herein may include a media processing device enclosing a media feed path, where the media processing device is configured to feed a media substrate comprising media unit thereon along the media feed path in a media feed direction. The media processing device may include a printhead and a platen roller. The printhead may extend across the media feed path in a longitudinal direction between a first end and a second end, where the printhead defines a backfeed deflection surface extending at least partially between the first end and second end of the printhead proximate to the media feed path. The platen roller may be structured in at least indirect engagement with the printhead, the platen roller may be configured to feed the media substrate along the media feed path in the media feed direction, and to backfeed the media substrate along the media feed path in a backfeed direction that is opposite the media feed direction. The backfeed deflection edge may be structured to guide the printhead over media units disposed on the media substrate as the media is moved in the backfeed direction. The media processing device may include a longitudinally extending biasing element extending along the length of the printhead, where the biasing force receiving element is engaged with the longitudinally extending biasing element. The longitudinally extending biasing element may engage the biasing force receiving element about at least a portion of the radius. Embodiments may include a rotation stop element, where the rotation stop element precludes rotation of the printhead about a first axis greater than a predefined amount of rotation. The predefined amount of rotation may be about 0.3 millimeters at a point where the printhead at least indirectly engages the platen roller.

Embodiments of the present invention may provide a media processing device including a frame, a media feed path defined through the frame, a printhead assembly, a platen roller, and a rotation stop. The printhead assembly may include a printhead having a length extending longitudinally along a direction perpendicular to the media feed path, where the printhead assembly is configured to rotate relative to the frame about at least one axis. The platen roller may have an axis of rotation perpendicular to the media feed path, where the platen roller may be configured to at least indirectly engage the printhead along its length, and a print line is defined at a nip where the printhead engages the platen roller along the length of the printhead. The rotation stop may be configured to limit the degree of rotation of the printhead assembly about at least one axis. A media feed direction may be defined along the media feed path in a first direction, and a back feed direction may be defined along the media feed path in a second direction, opposite the first direction. The printhead may include a backfeed deflection edge extending along at least a portion of the length of the printhead, where the backfeed deflection edge may be configured to guide media units of a media substrate between the printhead and the platen roller in response to the media substrate being moved in the backfeed direction.

According to some embodiments, the backfeed deflection edge may include a radius of about 0.010 inches. Optionally, the backfeed deflection edge may include a chamfer of about 45 degrees and about 0.020 in width. The printhead assembly may be configured to rotate relative to the frame about two orthogonal axes. The rotation stop may be configured to limit the degree of rotation of the printhead assembly about both orthogonal axes. The media processing device may include a biasing element attached to the frame, where the printhead assembly may include a biasing force receiving element and the biasing element may be configured to apply a biasing force to the biasing force receiving element. The biasing force receiving element may include a rounded profile, and the biasing element may be configured to engage the biasing force receiving element about a portion of the rounded profile. The biasing element may remain fixed relative to the frame, and the biasing force receiving element may enable rotation of the printhead relative to the frame about both orthogonal axes. A first one of the orthogonal axes may be parallel to the axis of rotation of the platen roller, and a second one of the orthogonal axes may be along the direction of the media feed path.

Embodiments of the present invention may provide a media processing device including a frame, a media feed path defined through the frame, a printhead assembly, and a platen roller. A media feed direction may be defined along the media feed path in a first direction and a backfeed direction may be defined along the media feed path in a second direction, opposite the first direction. The printhead assembly may include a printhead that has a length extending longitudinally along a direction perpendicular to the media feed path, where the printhead assembly is configured to rotate relative to the frame about at least one axis. The platen roller may have an axis of rotation perpendicular to the media feed path, where the platen roller may be configured to at least indirectly engage the printhead along its length, and a print line may be defined at a nip where the printhead engages the platen roller along the length of the printhead. The printhead may include a leading edge proximate the print line, and the leading edge may include a backfeed deflection edge. The backfeed deflection edge may include a radius of about 0.010 inches. Optionally, the backfeed deflection edge may include a chamfer of about 45 degrees and about 0.020 inches in width. The printhead assembly may be configured to rotate relative to the frame about two orthogonal axes. Embodiments may include a rotation stop configured to limit the degree of rotation of the printhead assembly about at least one of the two orthogonal axes.

According to some embodiments, the media processing device may include a biasing element extending along the length of the printhead, where the biasing element may be attached to the frame at each of two opposing ends. The printhead bracket may include a biasing force receiving element, where the biasing element may be configured to engage the biasing force receiving element proximate a midpoint of the biasing element. A biasing force received at the biasing force receiving element may be distributed evenly across the print line.

BRIEF DESCRIPTION OF THE DRAWINGS

Figure 1:
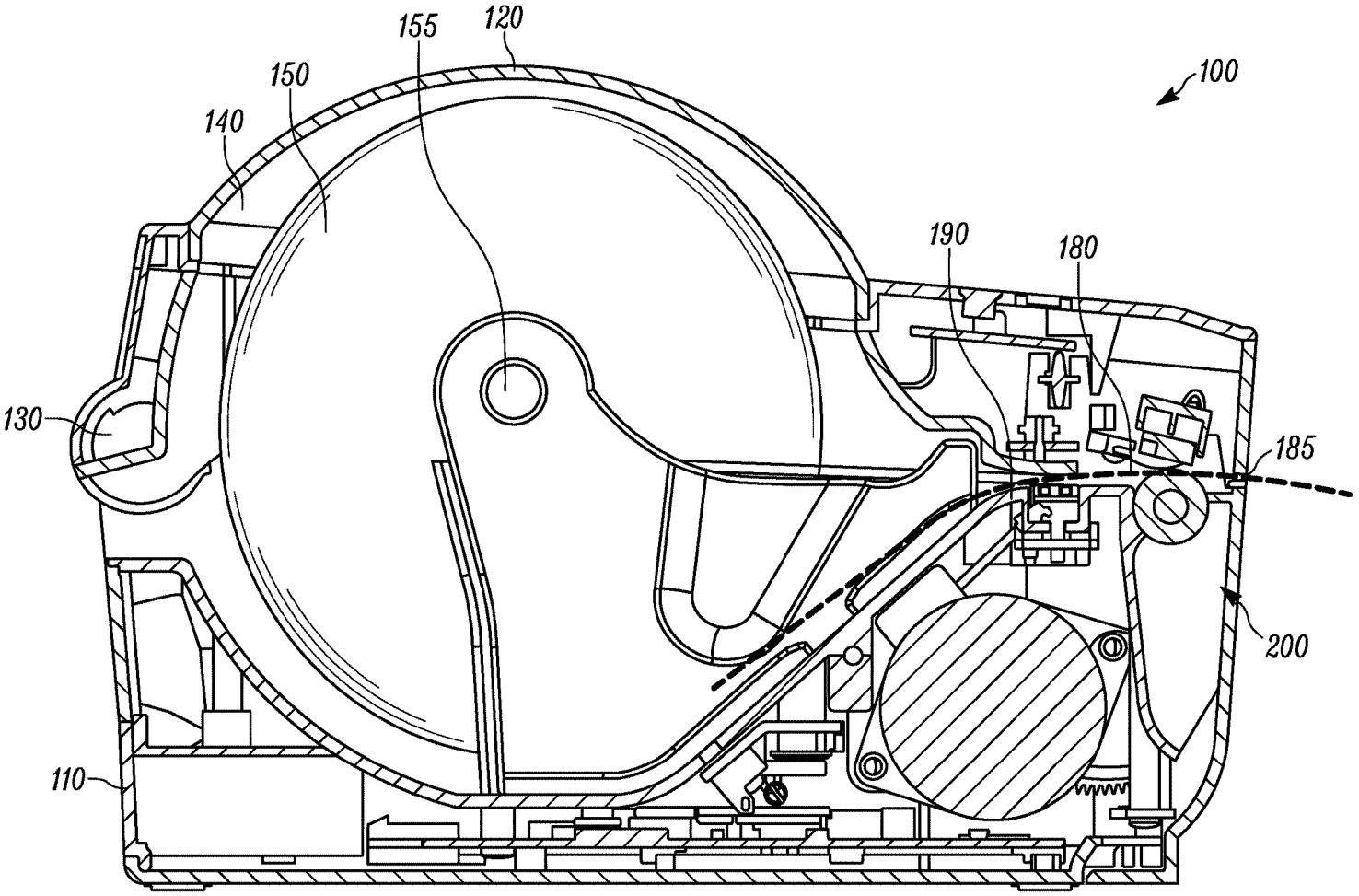
Figure 2:
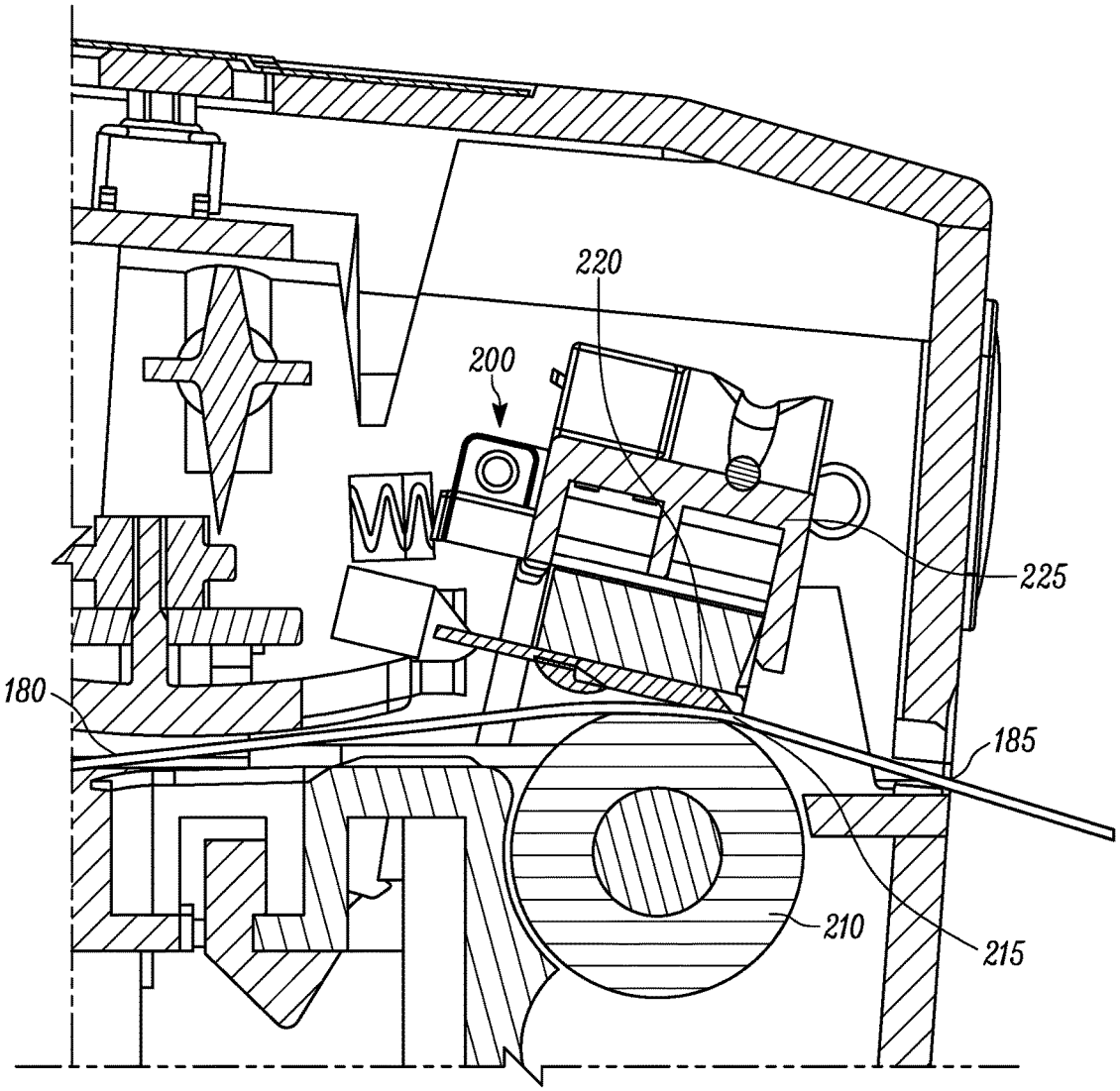
Figure 3:
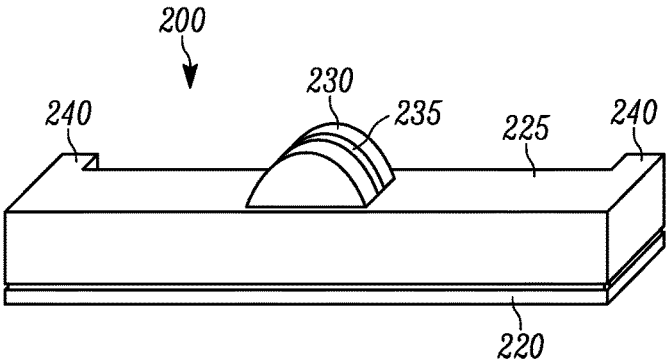
Figure 4:
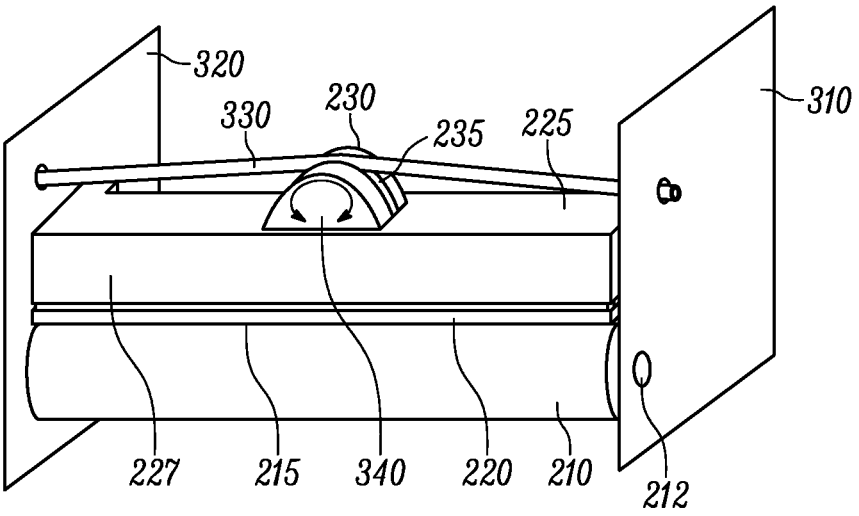
Figure 5:
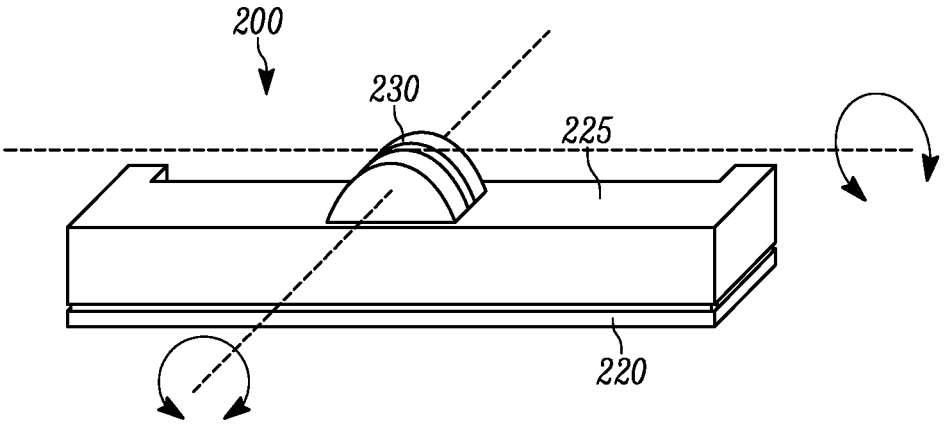
Figure 6:
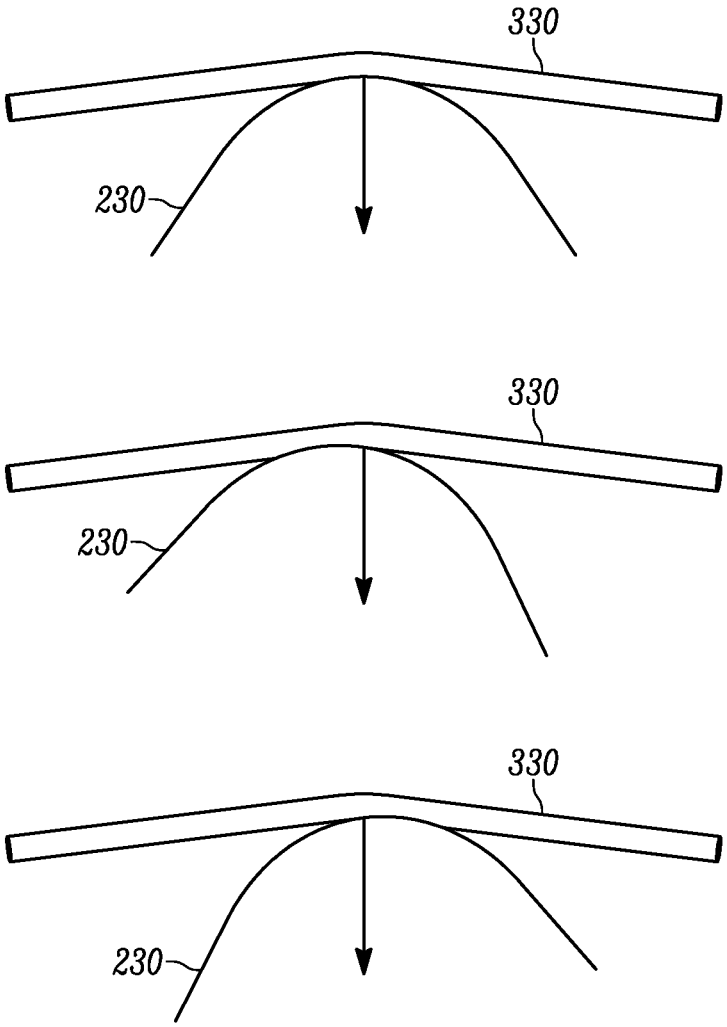
Figure 7:
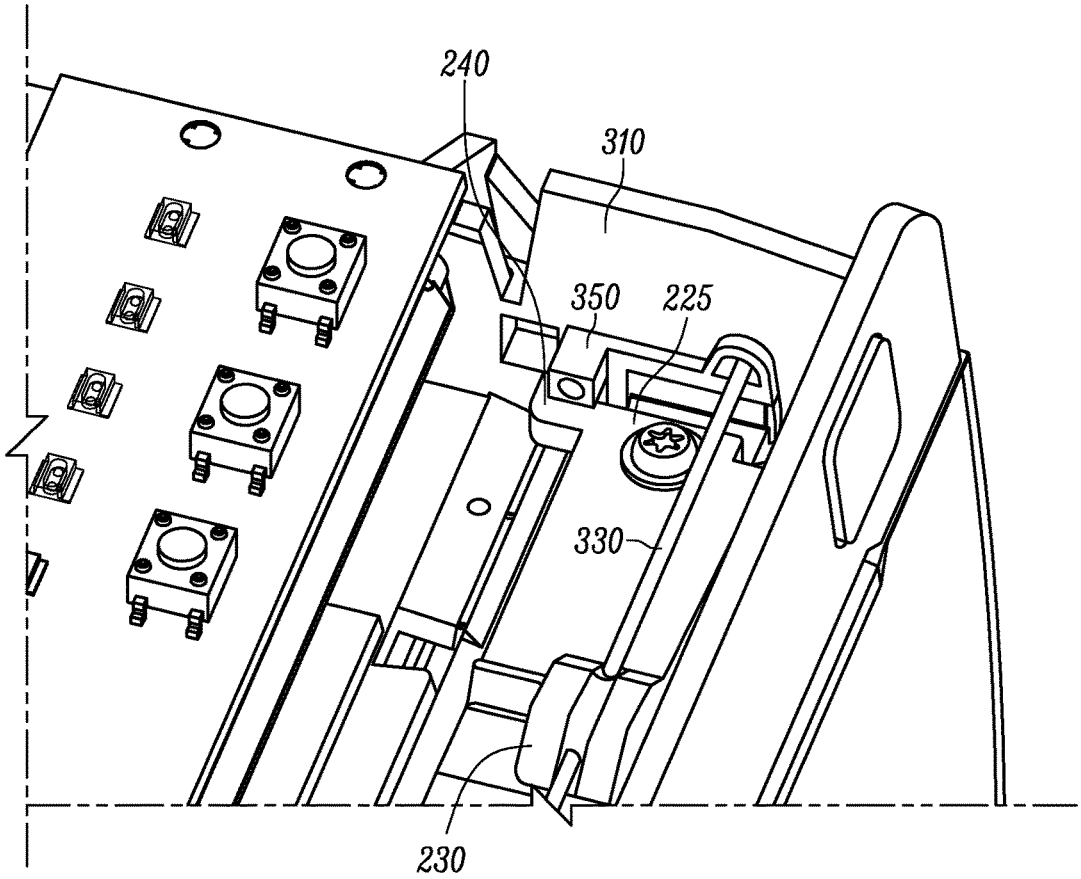
Figure 8:
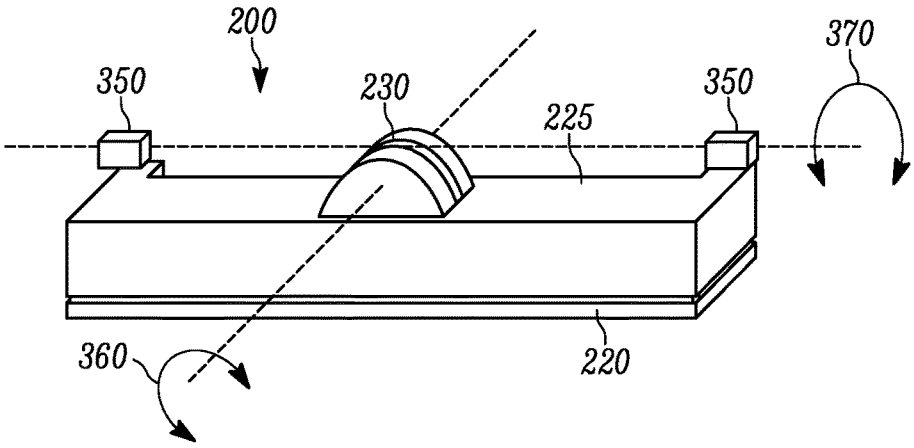
Figure 9:
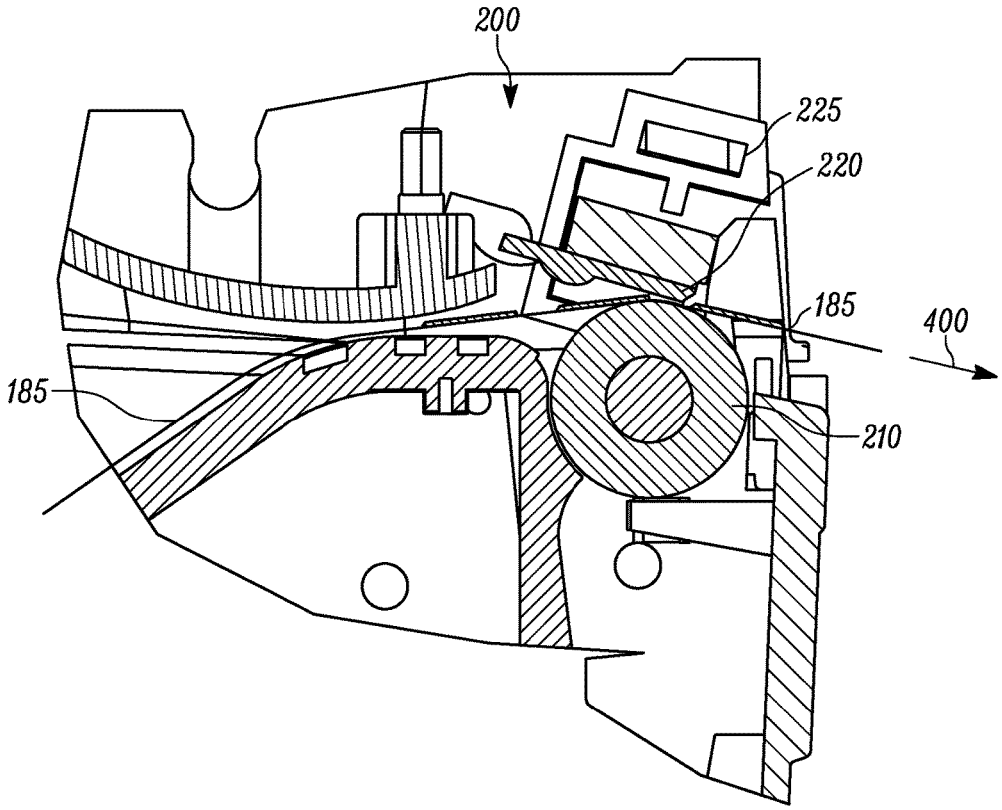
Figure 10:
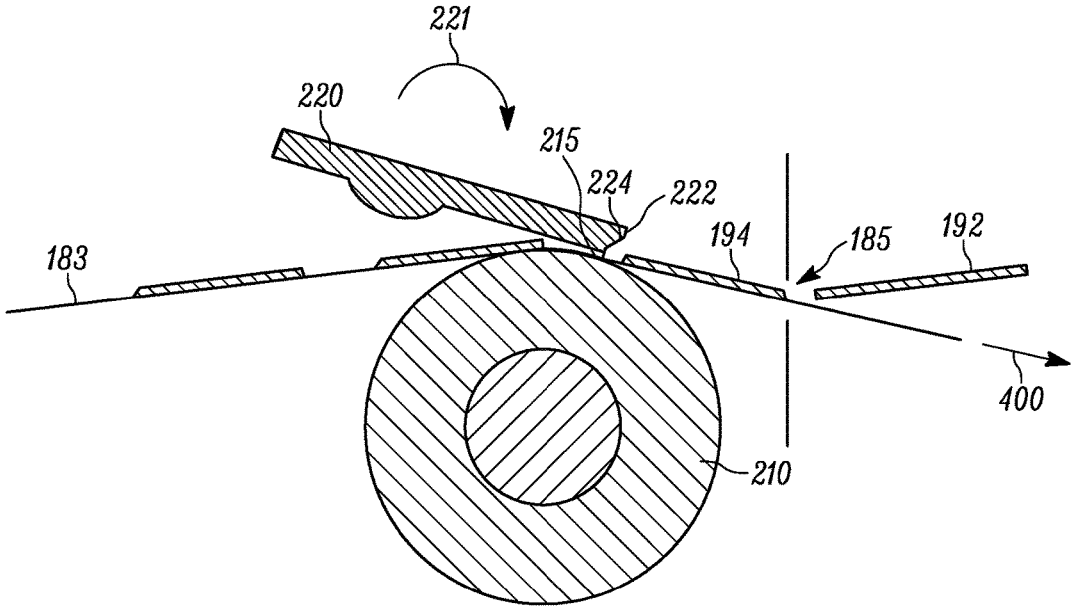

Having thus described the invention in general terms, reference will now be made to the accompanying drawings, which are not necessarily drawn to scale, and wherein:

FIG. 1 illustrates a cross-section view of a media processing device according to example embodiments of the present invention;

FIG. 2 illustrates a detail view of the media processing station of the media processing device of FIG. 1 according to an example embodiment of the present invention;

FIG. 3 illustrates a printhead assembly according to an example embodiment of the present invention;

FIG. 4 illustrates a printhead assembly as engaged with a portion of a frame of a media processing device according to an example embodiment of the present invention;

FIG. 5 illustrates a printhead assembly including axes of rotation according to an example embodiment of the present invention;

FIG. 6 depicts the engagement between a biasing member and a biasing force receiving element of a printhead assembly according to an example embodiment of the present invention;

FIG. 7 illustrates a printhead assembly as received within a media processing device according to an example embodiment of the present invention;

FIG. 8 illustrates a printhead assembly including axes of rotation and rotation limiting stops according to an example embodiment of the present invention;

FIG. 9 is another detail view of the media processing station of the media processing device of FIG. 1 according to an example embodiment of the present invention; and FIG. 10 is a further detail view of the media processing station of FIG. 9 according to an example embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Printers and media processing devices may be configured to print and/or encode media drawn from a roll or spool. Such media may include a web supporting a plurality of individually cut media units, such as adhesive-backed and carrier-supported labels, or the media may be a continuous web such as a spool of linerless label media or direct thermal media. Printers process (e.g., print, encode, etc.) the media by drawing the media from the spool and routing the media proximate various processing components (e.g., printhead, RFID reader/encoder, magnetic stripe reader/encoder etc.). Processing the media from a spool may facilitate a continuous or batch printing process.

According to some embodiments, the media may be of the direct-thermal variety in which a thermal printhead is used to heat portions of the media as it is fed past the printhead in order to print indicia on the media. Direct-thermal printers used to print to direct-thermal media may use a printhead extending across a media feed path in order to print across the width of the media. The printhead may engage a platen roller, at least indirectly, along a print line, which is defined as the nip where the printhead and the thermal elements thereof engage the platen roller. It is important in direct-thermal printing that the printhead is properly aligned with the platen roller such that the nip defined between the printhead and the platen roller, where the printing occurs, aligns with the thermal elements of the printhead. Further, it is important that the printhead and platen roller maintain alignment when the media is passed through the nip along the media feed path for printing, and maintain a consistent, even pressure along the print line.

Embodiments of the present invention are directed to an improved method and system for providing alignment of the printhead with the platen roller and maintaining the alignment between the printhead and the platen roller during operation. Embodiments may further maintain consistent pressure across the printhead relative to the platen roller during operation to ensure a high level of print quality.

FIG. 1 illustrates a media processing device according to example embodiments of the present invention. The illustrated embodiment depicts a cross-section of a media processing device 100 in profile, as viewed perpendicularly to a media feed path 195. While the illustrated embodiments and description provided herein are directed primarily to a printing device, other media processing devices such as media encoders, label applicators, or laminators, may benefit from the mechanisms described. Further, an example embodiment of the present invention may provide printing, encoding, and/or laminating functionality in a single device.

The media processing device 100 of FIG. 1 includes a housing with a base 110 and a lid 120. According to the illustrated embodiment, the lid 120 and the base 110 are arranged in a closed position in which the lid 120 is secured to the base 110. The lid 120 may be hingedly attached to the base 110 along a hinge 130, which may be located, for example, along a back side of the media processing device. According to some embodiments, a cavity 140 may be defined between the lid 120 and the base 110. The cavity may be inaccessible when the lid 120 is closed relative to the base 110 as shown in FIG. 1; however, the cavity 140 may be accessible to a user when the lid 120 is moved to an open position relative to the base 110 as will be described further below.

Within the cavity 140 of example embodiments may be a media receiving area in which a spool of media 150 may be received. A media spool 150 may be received, for example, on a media spindle 155 as shown in FIG. 1. While the illustrated embodiment of FIG. 1 includes a spool of continuous media, embodiments of the invention may also be configured to receive fan-fold media stacks, a stack or cartridge of individual media units (e.g., RFID cards), or the like. The media may be fed from the media spool 150 (or other media source within the cavity 140) along media feed path 180 to media exit 185, where the processed media exits the media processing device 100. The media feed path 180 may include media guides 190 configured to guide the media along the media feed path 180, to where the media is processed.

According to the illustrated embodiment, the media 150 may be processed at media processing station 200. FIG. 2 illustrates a detail view of the media processing station 200, including the media feed path passing between the platen roller 210 and the printhead 220. The nip 215 defined between the printhead 220 and the platen roller 210 extends longitudinally along the length of the printhead 220 where it interfaces with the platen roller 210. This longitudinally extending nip 215 defines the print line where the media 150 is processed along the media feed path 180.

The printhead 220 of the illustrated embodiment is attached to and supported by a printhead bracket 225. The printhead 220 and printhead bracket 225 are components of the printhead assembly which is supported within the housing 110, 120, by a frame (not shown in FIG. 2). The printhead 220 is held fixed relative to the printhead bracket 225 such that movement imparted to the bracket translates to the printhead. In this manner, it is desirable to control the movement of the printhead by way of controlling the movement of the printhead bracket 225. An example of a printhead assembly according to some embodiments of the present invention is depicted in FIG. 3, which illustrates that printhead bracket 225 and the printhead 220. According to the illustrated embodiment, the printhead bracket further includes a biasing force receiving element 230, the function of which will be detailed further below. The printhead assembly of FIG. 3 further illustrates rotation limiting tabs 240 extending from a rear-side of the printhead bracket 225.

As noted above, embodiments described herein are directed to an apparatus, system, and method for aligning a printhead with a platen roller to optimally position the print line, and to maintain the printhead in at least indirect engagement with the platen roller with a consistent, uniform pressure. In order to achieve this, one aspect of the present invention is the ability of the printhead to "float" relative to the platen roller. The term "float" is used herein to describe the freedom of at least some degree of movement in multiple directions. The configuration of the media processing device and the printhead assembly of example embodiments enable this floating printhead configuration. FIG. 4 illustrates a detail perspective view of a printhead assembly of example embodiments together with portions of a media processing device. Components of the media processing device are omitted for purposes of illustration and ease of explanation. According to the depicted embodiment, the media processing device includes a frame including a first frame portion 310 and a second frame portion 320. The frame portions 310, 320 are disposed adjacent to first and second opposing ends of the printhead assembly comprising the printhead 220, printhead bracket 225, and biasing force receiving element 230. The illustrated embodiment further includes platen roller 210 which may be mounted to the frame portions as illustrated at 212. The platen roller may be fixedly mounted to the frame such as by bearings, or the platen roller may be mounted to the frame in such a manner as to bias the platen roller toward engagement with a printhead. According to the illustrated embodiment, the platen roller 210 is in a fixed position relative to the frame portions 310, 320. While not illustrated, the platen roller may also be a driven roller to advance media along the media feed path, which passes between the platen roller 210 and the printhead 220 at print line/nip 215.

As noted above, the printhead 220 of example embodiments may be configured to float relative to the frame. The printhead 220 may be configured to be movable to some extent along the media feed path, fore and aft. The media feed path may define a first direction or processing direction along the media feed path in the direction media is advanced during processing. A second direction may be defined along the media feed path in a direction opposite the processing direction, in a reverse direction. The printhead may be able to move fore and aft along the first and second direction of the media feed path between a forward stop (not shown), configured to engage the leading edge 227 of the printhead bracket 220, and a reverse stop (not shown), configured to engage the trailing edge 229 of the printhead bracket 220. The forward stop and the reverse stop may be fixedly mounted or part of the frame. The ability of the printhead assembly to move fore and aft along the media feed path may allow the printhead to properly align with the platen roller 210 to optimize print quality.

The printhead assembly may also be configured to move perpendicularly relative to the platen roller 210, such as to allow media of differing thicknesses to pass between the printhead 220 and the platen roller 220 through print line 215 while maintaining contact between the printhead and the media. The illustrated embodiment of FIG. 4 depicts a biasing element 330 that is configured to apply a biasing force to the printhead assembly toward the platen roller 210 in order to encourage engagement between the printhead 220 and the platen roller 210. The illustrated biasing element comprises a rod extending from the first frame portion 310 to the second frame portion 320. The rod may include any deformable material, where the selected deformable material and size of the rod (i.e., diameter) may determine the force per unit of deflection. According to an example embodiment, the rod may be a metal such as a spring steel, with a diameter of between about 0.025 and 0.125 inches. In other example embodiments, the rod may include a high-density polyethylene and may include a diameter of about 0.150 and 0.300 inches. The rod may be held fixed on either end within the first and second portions of the frame 310, 320, while the biasing force receiving element 230 deflects the biasing element 330, thereby receiving the biasing force.

The biasing force receiving element 230 may include a rounded engagement surface having a radius as shown in the illustrated embodiment, where the biasing element 330 is deflected and bends around at least a portion of the rounded engagement surface radius. The biasing force receiving element of example embodiments may include a channel 235 extending about at least a portion of the radius, where the biasing element 330 is received within the channel 235 to hold the biasing element relative to the biasing force receiving element. This engagement between the biasing element 330 and the channel 235 may further aid in limiting movement of the printhead bracket 225, and hence printhead assembly, fore and aft along the media feed path.

The shape and configuration of the biasing force receiving element 230, together with the biasing element 330 may enable additional degrees of freedom of movement of the printhead assembly relative to the frame portions 310, 320, and relative to the platen roller 210. The biasing force receiving element 230 with the radius of the rounded engagement surface, in concert with the elongate biasing element 330, may enable the printhead bracket 225 to pivot relative to the frame about the axis of the radius of the biasing force receiving element, as shown in FIG. 4 at arrow 340. Further, the biasing force receiving element channel 235, in concert with a rounded profile to the elongate biasing element 330, may enable the printhead bracket to pivot about an axis of the elongate biasing element where it contacts the biasing force receiving element, which is orthogonal to the pivot direction of arrow 340. FIG. 5 more clearly illustrates the orthogonal axes about which the printhead assembly 200 may pivot while floating according to example embodiments described herein.

The configuration of the biasing element 330 and the biasing force receiving element 340 is further configured to apply pressure to the printhead 220 in a direction that is normal to the platen roller 210, regardless of the rotation of the printhead assembly relative to the biasing element. FIG. 6 illustrates how the biasing force applied via biasing element 330 to biasing force receiving element 230 remains normal to the platen roller regardless of orientation of the printhead assembly relative to the frame. It is noted that the degree of rotation illustrated in FIG. 6 is exaggerated for ease of understanding.

While the aforementioned features of example embodiments of the present invention illustrate how the multiple degrees of freedom of movement of the printhead assembly are achieved, the degree of movement may be limited in order to provide limited floating freedom and maintain print quality. FIG. 7 illustrates another view of the floating printhead assembly of example embodiments including the printhead bracket 225, the first frame portion 310, and biasing element 330 engaged with biasing force receiving element 230. The depicted embodiment further includes the rotation limiting tab 240 of the printhead bracket. As shown, the first frame portion 310 includes a rotation stop 350 configured to engage the rotation limiting tab 240 in response to the rotation of the printhead bracket 225 reaching a maximum allowed rotation. A similar rotation stop 350 and rotation limiting tab 240 may be found on the second frame portion 320 and the opposite end of the printhead bracket 225, respectively. These rotation stops 350 may limit rotation of the printhead bracket in both rotational directions around the axis defined through the axis of the radius of the rounded engagement surface of the biasing force receiving element 230, and in at least one rotational direction around the axis defined through the biasing element parallel to the printhead bracket 225.

FIG. 8 illustrates a printhead assembly including printhead bracket 225 and rotation limiting stops 350, while the remainder of the media processing device housing and frame has been omitted for ease of understanding. As shown, the rotation stops 350 limit rotation about the axis defined through the center of the radius of the rounded engagement surface of the biasing force receiving element 230 shown by arrow 360. The rotation stops 350 further limit rotation in at least one rotational direction about the axis defined through the biasing element 330 where it engages the biasing force receiving element 230, shown as arrow 370. While the rotation stops 350 may only limit rotation in one rotational direction of arrow 370, the position of the biasing element 330, and the front of the frame of the media processing device may serve to limit rotation in the opposite rotational direction.

As described above, example embodiments may provide a method, apparatus, and system for a floating printhead assembly that provides alignment of the printhead with the platen roller and maintains the alignment between the printhead and the platen roller during operation. Embodiments further maintain consistent pressure across the printhead relative to the platen roller during operation to ensure a high level of print quality. According to another aspect of embodiments described herein, the printhead assembly may further enhance printing capabilities by minimizing problems encountered while processing small media units disposed on a media substrate, backing, carrier, or web.

Embodiments of a media processing device described herein may process adhesive labels that are carried on a media substrate, which may be, for example, a web of material coated with a release layer. When processing media units, such as when printing labels, the printing process may feed the media units and substrate along the media feed path 180 of FIG. 1. FIG. 9 illustrates a detail view of the processing station 200 of a media processing device, including a media feed path 180 and a media exit 185. Media, comprising media units disposed on a media substrate, is processed as the media is fed along the media feed path 180 in a media feed direction, illustrated by arrow 400. When the media is processed and a media unit is presented at media exit 185 for a user to retrieve, the subsequent media unit may be passed through the media processing station 200, past printhead 220 in the media feed direction 400, without first being processed. This may be to allow a user to retrieve a media unit, when the processing device is not prepared, or not instructed to process a subsequent media unit. After the media unit is retrieved, the subsequent media unit, which may have passed through the media processing station 200, may be moved in a backfeed direction, opposite that of the media feed direction 400 to position the subsequent media unit for processing.

FIG. 10 illustrates another detail view of the media processing station 200 including the printhead 220 and the platen roller 210, and illustrating the aforementioned scenario. According to the illustrated embodiment, media unit 192 on media substrate 183 has been processed and is advanced to media exit 185. The media unit 192 may be removed (e.g., the media substrate may be torn or the media unit may be removed from the media substrate 183 as illustrated), while the subsequent media unit 194, which may not yet have been processed, is advanced past the print line at nip 215. After media unit 192 is retrieved, the media processing device may backfeed the media substrate 183 in a reverse direction, opposite that of the media feed direction shown by arrow 400. The reversal of the media substrate may cause the floating printhead 220 to tilt or rotate about arrow 221. This rotation is a result of having a floating printhead (and printhead assembly) with a limited degree of freedom of movement. The rotation of the printhead 220 causes a leading edge 222 of the printhead to tilt down toward the media substrate 183. A conventional printhead in such a position would pose an issue with reversing media units on the media substrate as the media units may encounter a relatively sharp leading edge of a conventional printhead, resulting in media unit 194 being peeled from the substrate 183 as the substrate is reversed in the backfeed direction in an effort to position media unit 194 in the printing nip 215 for processing. However, according to example embodiments of the present invention, a printhead may include a backfeed deflection edge 224 proximate the leading edge 222 of the printhead. This backfeed deflection edge 224 may guide the media unit 194 beneath the printhead 220 and through the nip 215 when the media substrate 183 is reversed.

The backfeed deflection edge 224 of example embodiments may be any surface that eases the transition between a leading edge 222 and a print line surface that are at a substantially right angle relative to one another. This backfeed deflection edge 224 may be a chamfer arranged at about 30 to 60 degrees relative to the leading edge 222 of the printhead 220, but may preferably be about 45 degrees. The backfeed deflection edge 224 may optionally be a curved surface, with a radius of about half of a height of the leading edge 222 to about the full height of the leading edge 222. The backfeed deflection edge 224 may optionally be a curved surface without a consistent radius, or may be a series of chamfers similar to a curved surface. The intent of the backfeed deflection edge 224 is to guide the media unit 194 beneath the printhead 220, between the printhead 220 and the platen roller 210, as the media substrate 183 is moved in a backfeed direction opposite the media feed direction 400. As such, the backfeed deflection edge 224 may be any profile that encourages this process without resulting in the media unit 194 being peeled from the substrate 183.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A media processing device enclosing a media feed path, wherein the media processing device is configured to feed a media substrate comprising media units thereon along the media feed path in a media feed direction, the media processing device comprising:

a printhead extending across the media feed path in a longitudinal direction between a first end and a second end, wherein the printhead defines a backfeed deflection surface extending at least partially between the first end and second end of the printhead proximate to the media feed path; and a platen roller structured in at least indirect engagement with the printhead, the platen roller configured to feed the media substrate along the media feed path in the media feed direction and to backfeed the media substrate along the media feed path in a backfeed direction that is opposite to the media feed direction, wherein the backfeed deflection edge is structured to guide the printhead over media units disposed on the media substrate as the media is moved in the backfeed direction.

2. The media processing device of claim 1, further comprising a biasing force receiving element disposed on the printhead bracket, wherein the biasing force receiving element comprises a rounded profile having a radius, wherein the radius is about an axis that is perpendicular to the longitudinal direction along which the printhead extends.

3. The media processing device of claim 2, further comprising a longitudinally extending biasing element extending along the length of the printhead, wherein the biasing force receiving element is engaged with the longitudinally extending biasing element.

4. The media processing device of claim 3, wherein the longitudinally extending biasing element engages the biasing force receiving element about at least a portion of the radius.

5. The media processing device of claim 1, further comprising a rotation stop element, wherein the rotation stop element precludes rotation of the printhead about a first axis greater than a predefined amount of rotation.

6. The media processing device of claim 5, wherein the predefined amount of rotation is about 0.3 millimeters at a point where the printhead at least indirectly engages the platen roller.

7. A media processing device comprising:

a frame;

a media feed path defined through the frame;

a printhead assembly comprising a printhead, wherein the printhead comprises a length extending longitudinally along a direction perpendicular to the media feed path, and wherein the printhead assembly is configured to rotate relative to the frame about at least one axis;

a platen roller with an axis of rotation perpendicular to the media feed path, wherein the platen roller is configured to at least indirectly engage the printhead along its length, and wherein a print line is defined at a nip where the printhead engages the platen roller along the length of the printhead; and a rotation stop configured to limit the degree of rotation of the printhead assembly about the at least one axis.

8. The media processing device of claim 7, wherein a media feed direction is defined along the media feed path in a first direction, and a backfeed direction is defined along the media feed path in a second direction, opposite the first, wherein the printhead comprises a backfeed deflection edge extending along at least a portion of the length of the printhead, wherein the backfeed deflection edge is configured to guide media units of a media substrate between the printhead and the platen roller in response to the media substrate being moved in the backfeed direction.

9. The media processing device of claim 8, wherein the backfeed deflection edge comprises a radius of about 0.010 inches.

10. The media processing device of claim 8, wherein the backfeed deflection edge comprises a chamfer of about 45 degrees and about 0.020 in width.

11. The media processing device of claim 7, wherein the printhead assembly is configured to rotate relative to the frame about two orthogonal axes.

12. The media processing device of claim 11, wherein the rotation stop is configured to limit the degree of rotation of the printhead assembly about both orthogonal axes.

13. The media processing device of claim 7, further comprising a biasing element attached to the frame, wherein the printhead assembly comprises a biasing force receiving element, and wherein the biasing element is configured to apply a biasing force to the biasing force receiving element.

14. The media processing device of claim 13, wherein the biasing force receiving element comprises a rounded profile, and wherein the biasing element is configured to engage the biasing force receiving element about a portion of the rounded profile.

15. The media processing device of claim 14, wherein the biasing element remains fixed relative to the frame, and wherein biasing force receiving element enables rotation of the printhead relative to the frame about both orthogonal axes.

16. The media processing device of claim 14, wherein a first one of the orthogonal axes is parallel to the axis of rotation of the platen roller, and a second one of the orthogonal axes is along the direction of the media feed path.

17. A media processing device comprising:

a frame;

a media feed path defined through the frame, wherein a media feed direction is defined along the media feed path in a first direction, and a backfeed direction is defined along the media feed path in a second direction, opposite the first direction;

a printhead assembly comprising a printhead, wherein the printhead comprises a length extending longitudinally along a direction perpendicular to the media feed path, and wherein the printhead assembly is configured to rotate relative to the frame about at least one axis; and a platen roller with an axis of rotation perpendicular to the media feed path, wherein the platen roller is configured to at least indirectly engage the printhead along its length, and wherein a print line is defined at a nip where the printhead engages the platen roller along the length of the printhead;

wherein the printhead comprises a leading edge proximate the print line, and wherein the leading edge comprises a backfeed deflection edge.

18. The media processing device of claim 17, wherein the backfeed deflection edge comprises a radius of about 0.010 inches.

19. The media processing device of claim 17, wherein the backfeed deflection edge comprises a chamfer of about 45 degrees and about 0.020 in width.

20. The media processing device of claim 17, wherein the printhead assembly is configured to rotate relative to the frame about two orthogonal axes.

21. The media processing device of claim 20, further comprising a rotation stop configured to limit the degree of rotation of the printhead assembly about at least one of the two orthogonal axes.

22. The media processing device of claim 21, further comprising a biasing element extending along the length of the printhead, and wherein the biasing element is attached to the frame at each of two opposing ends.

23. The media processing device of claim 22, wherein the printhead bracket comprises a biasing force receiving element, and wherein the biasing element is configured to engage the biasing force receiving element proximate a midpoint of the biasing element.

24. The media processing device of claim 23, wherein a biasing force received at the biasing force receiving element from the biasing element is distributed evenly across the print line.

* * * * *